US009004118B2

(12) United States Patent
Keem

(10) Patent No.: US 9,004,118 B2
(45) Date of Patent: Apr. 14, 2015

(54) FILLING SYSTEM

(75) Inventor: Phil Keem, Camberwell (AU)

(73) Assignee: Reckitt Benckiser N. V., WT Hoofddorp (NL)

( * ) Notice: Subject to any disclaimer, the term of this patent is extended or adjusted under 35 U.S.C. 154(b) by 1362 days.

(21) Appl. No.: 12/295,895

(22) PCT Filed: Apr. 5, 2007

(86) PCT No.: PCT/GB2007/001311

§ 371 (c)(1),
(2), (4) Date: Oct. 3, 2008

(87) PCT Pub. No.: WO2007/128986

PCT Pub. Date: Nov. 15, 2007

(65) Prior Publication Data

US 2009/0205749 A1 Aug. 20, 2009

(30) Foreign Application Priority Data

Apr. 6, 2006 (GB) ..... 0606909.0
Jan. 3, 2007 (GB) ..... 0700039.1

(51) Int. Cl.
*B65B 1/04* (2006.01)
*D06F 39/02* (2006.01)

(52) U.S. Cl.
CPC ..... *D06F 39/022* (2013.01)

(58) Field of Classification Search
CPC ..... D06F 39/022
USPC ..... 141/311 R, 350; 222/325, 548, 555, 222/513, 651–652; 251/155, 142, 149.8, 251/144, 149.2, 149.5, 156; 285/361, 396, 285/402
See application file for complete search history.

(56) References Cited

U.S. PATENT DOCUMENTS

| | | | | | |
|---|---|---|---|---|---|
| 796,084 | A * | 8/1905 | Orr | 285/396 |
| 1,823,234 | A * | 9/1931 | Bell | 285/90 |
| 2,382,348 | A * | 8/1945 | Taylor | 285/148.23 |
| 3,470,524 | A * | 9/1969 | Culver | 439/317 |
| 4,032,050 | A * | 6/1977 | Funk | 222/284 |
| 5,495,962 | A * | 3/1996 | Nomura | 222/80 |
| 7,090,098 | B2 * | 8/2006 | Livingston et al. | 222/651 |

FOREIGN PATENT DOCUMENTS

| | | | | |
|---|---|---|---|---|
| EP | 0268451 A2 | | 5/1988 | |
| FR | 2146607 | * | 2/1973 | D06F 39/00 |
| FR | 2146607 A | | 3/1973 | |
| GB | 2260972 A | | 5/1993 | |
| WO | 2006001277 A | | 1/2006 | |

OTHER PUBLICATIONS

English Language Abstract Translation for FR2146607.

* cited by examiner

*Primary Examiner* — Jason Boeckmann
*Assistant Examiner* — Steven M Cernoch
(74) *Attorney, Agent, or Firm* — Norris McLauglin & Marcus PA

(57) ABSTRACT

A filling system for a detergent vessel comprises a reservoir (2) having a dispensing nozzle (3) and a detergent vessel (16) having a filling spout (15). The nozzle has a collar with engagement means which when inserted into the filling spout engage a portion of the filling spout providing an effective seal.

9 Claims, 8 Drawing Sheets

FILLING SYSTEM

This is an application filed under 35 USC 371 of PCT/GB2007/001311.

The present invention relates to a filling system for a detergent vessel.

Detergent vessels are commonplace in domestic/industrial environments. The vessels may be used for storage of detergent compositions or for dispense of detergents in use in a washing machine, over a single/number of washing cycles.

A problem exists with the use of such detergent vessels, where the vessel has to be filled with detergent from another detergent containing reservoir. Detergent compositions may not easily be transferred from one vessel to another. This problem arises because, in the case of powdered detergents it can be difficult to use an transferring implement such as a spoon without spilling detergent. Similar problems occur when transferring liquid detergent compositions as the liquid compositions often have high viscosity.

Here it must be appreciated that most detergent compositions are aggressive/caustic to the skin of a user as the compositions commonly comprise antagonistic ingredients such as bleaches/enzymes. Thus spillage of the detergent and subsequent contact of a user with the detergent should be minimised.

It is an object of the present invention to obviate/mitigate the problems outlined above.

According to a first aspect of the present invention there is provided a filling system for a detergent vessel comprising a reservoir having a dispensing nozzle and a detergent vessel having a filling spout, the nozzle having a collar with engagement means which when inserted into the filling spout engages a portion of the filling spout providing an effective seal.

The system of the present invention enables the filling of a detergent vessel without any spillage of any detergent composition. Thus not only is a user is not brought into contact with any potentially caustic composition but also the problems of wastage of detergent composition are avoided. Furthermore as the detergent may be transferred from the reservoir to the vessel with only minimal contact with the atmosphere any potential harm to the detergent is minimised in the transfer process.

The engagement system may be any engagement system known in the art. Preferred examples of engagement systems include those based on mechanical (e.g. frictional) or magnetic operation. Most preferably the engagement system is mechanical in nature It is preferred that the spout has a closure. Thus when the vessel is not being filled the danger of spillage of detergent through the spout/contamination of the detergent composition by material entering the spout is minimised. The closure generally comprises a flap that covers the bore of the spout. It is preferred that the flap is activated (moved into an open position) by insertion of the nozzle into the spout. It is preferred that the flap has an associated bias means that bias the flap into an in-activated position in the absence of an activating force being applied.

One method of flap activation is by simply inserting the nozzle into the spout, such that frictional force (e.g. from a "friction fit") caused by interaction between the nozzle and the spout, brings the flap into an activated position. Another method of flap activation is by inserting the nozzle into the spout, such that the leading edge of the nozzle abuts against the flap, pushing the flap into an activated position. More preferably the flap is activated by application of a rotational force. This may be achieved by providing a lug on the nozzle and an angled slot disposed around the spout. Thus as the nozzle is inserted into the spout the lug engages an angled slot, further insertion of the nozzle into the spout causes the lugs to be propelled along the slot and effecting rotation of the slot and the attached-closure. (Clearly a plurality of lugs and/or slots may be present. Also the positioning of the lug(s)/slot(s) on the nozzle/spout may be reversed/altered).

The flap activation may be brought about by a combination of individual steps (e.g. a plurality of steps from the paragraph above combined in a complex movement). For example the flap activation may be achieved in a "bayonet motion", a motion which involves a pushing motion and a twisting motion, with the individual steps being carried out in any order.

Additionally/alternatively the nozzle may have a closure. Such a nozzle closure, where present, preferable operates in a similar way to the closure on the spout.

Where a closure is present it is preferred that the closure is self closing. Namely it is preferred that the closure is able to close itself after use.

Generally the closure system comprises a plastics material such as polypropylene, polyethylene, polyvinylchloride or polyethylene terephthalate.

It is preferred that the detergent is a liquid detergent composition. Alternatively the detergent may be a flowable solid (e.g. a granular) composition. The detergent composition may vary with the use for which it is intended. However, it will be understood that the detergent composition will comprise at least one of the conventional detergent actives such as a surfactant, a bleach, an enzyme, a pH modifying agent, a fragrance, a builder, a bleach activator, a colouring agent or a thickener.

Preferably one or both of the reservoir/vessel has a breather valve so that transfer of detergent is not hampered by the presence of air in either the vessel/reservoir.

The breather valve, where present, may be operated (in a similar or different mechanism) to the closure for the spout/nozzle. Namely the breather valve may be designed such that it is only operational when the nozzle/spout is operational.

According to a second aspect of the invention there is provided a detergent dispensing reservoir having a dispensing nozzle, the nozzle having a collar with engagement means for engagement with a filling spout of a vessel.

Preferably the reservoir is in the form of a bottle with a suitable dispensing nozzle.

According to a third aspect of the invention there is provided a detergent vessel having a filling spout, the filling spout having receiving means capable of engagingly interacting with a filling nozzle.

The detergent vessel may be used for the storage of a detergent. The detergent vessel is more preferably for use in the dispense of a detergent composition (e.g. in an automatic washing machine such as a laundry washing machine or a dishwashing machine). The vessel may be intended for use in a single washing cycle (i.e. releasing its contents in a single cycle) or may be intended for use over a plurality of washing cycles.

The application will now be described with reference to the following Figures, in which:—

Figure 4A:
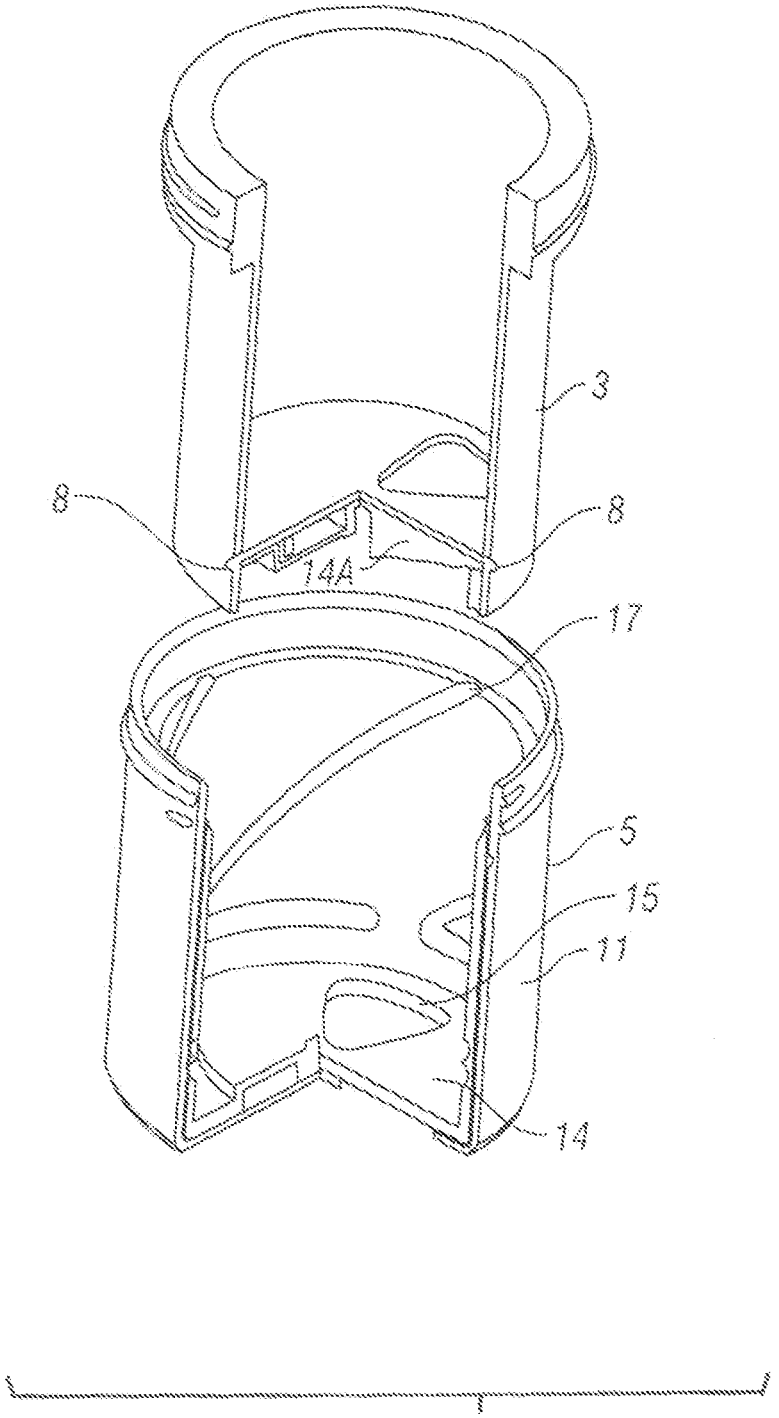
Figure 4B:
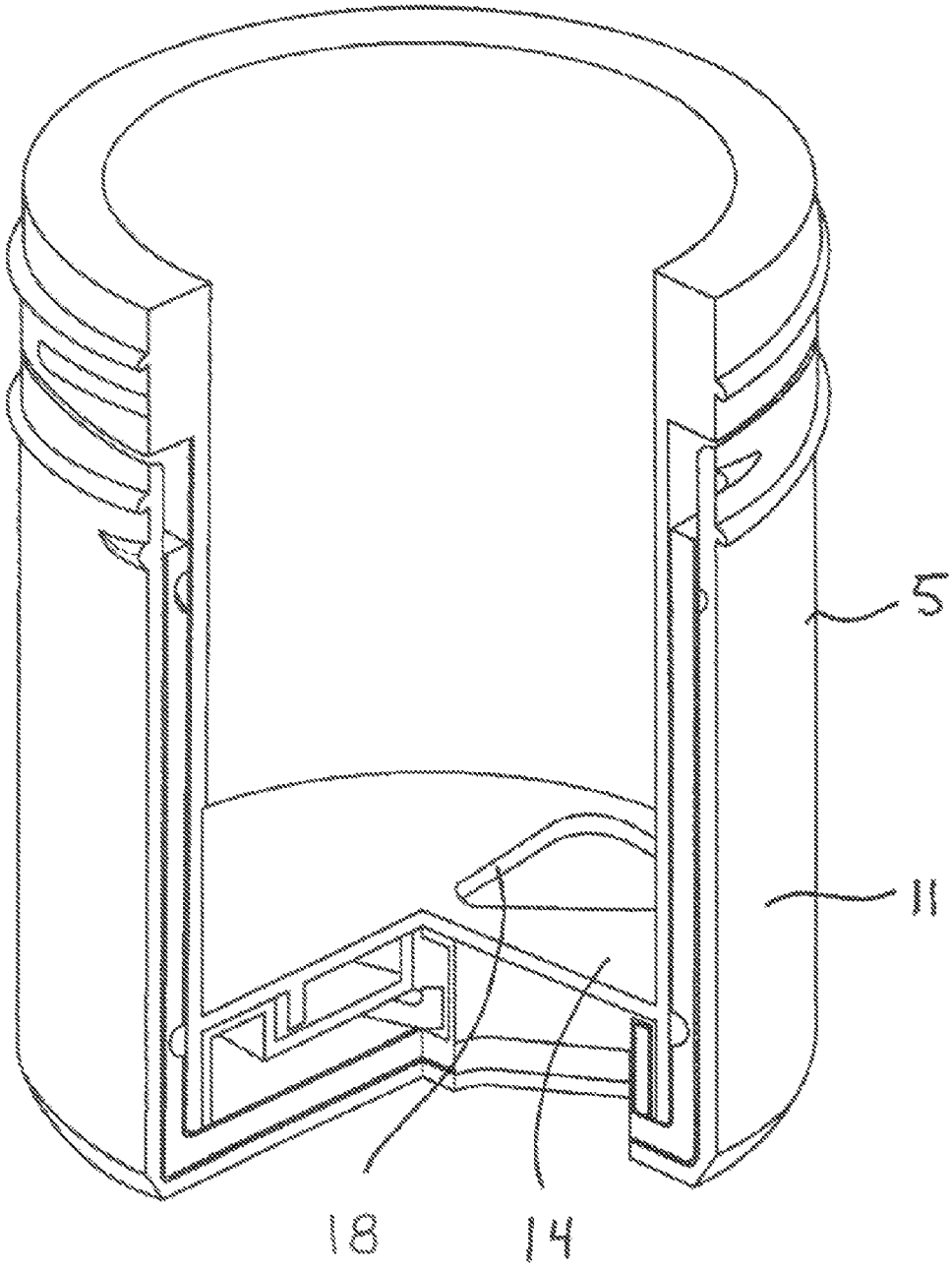
Figure 4C:
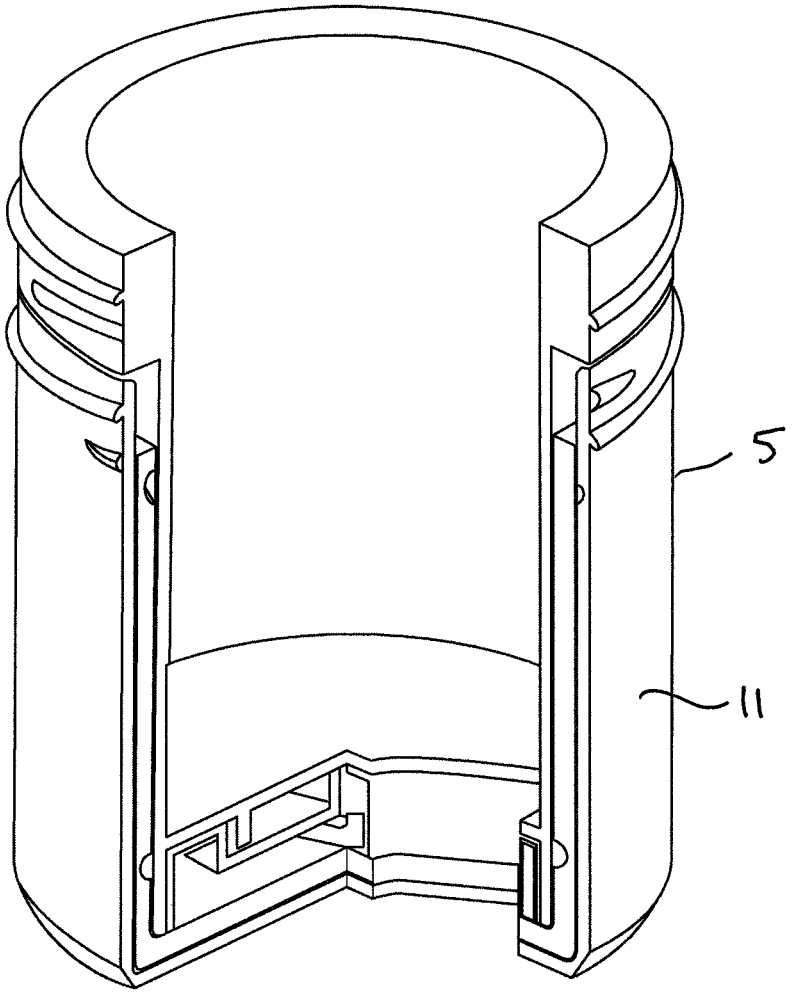
Figure 5A:
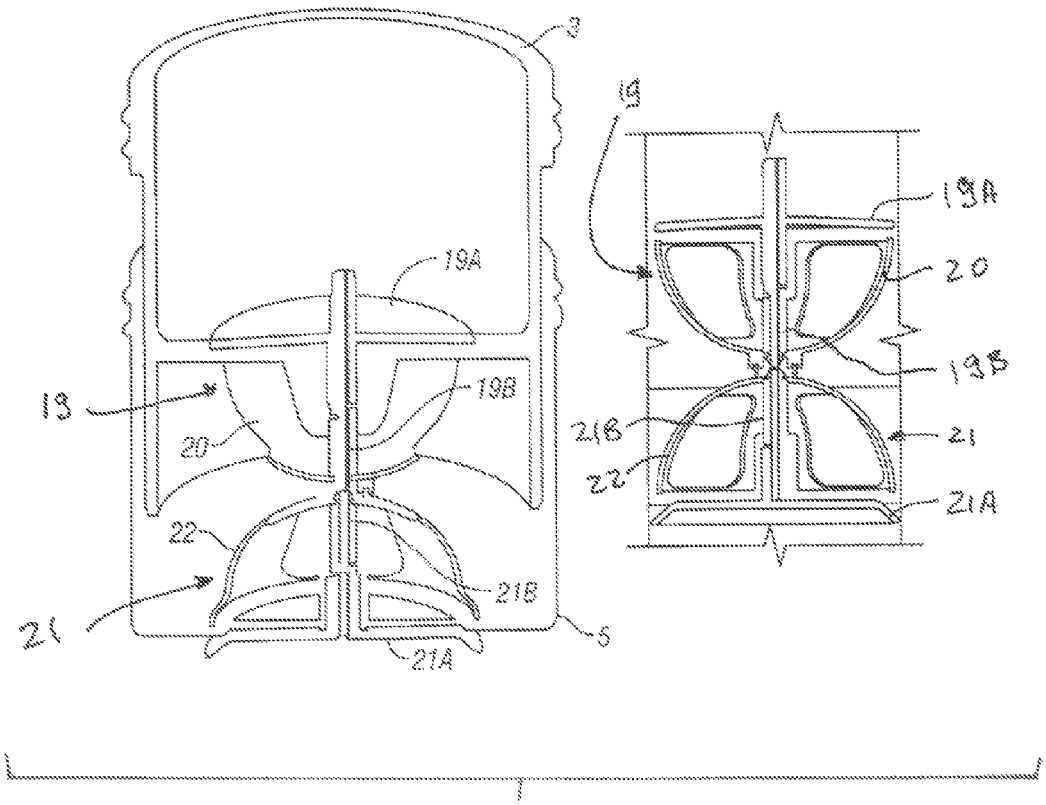
Figure 5B:
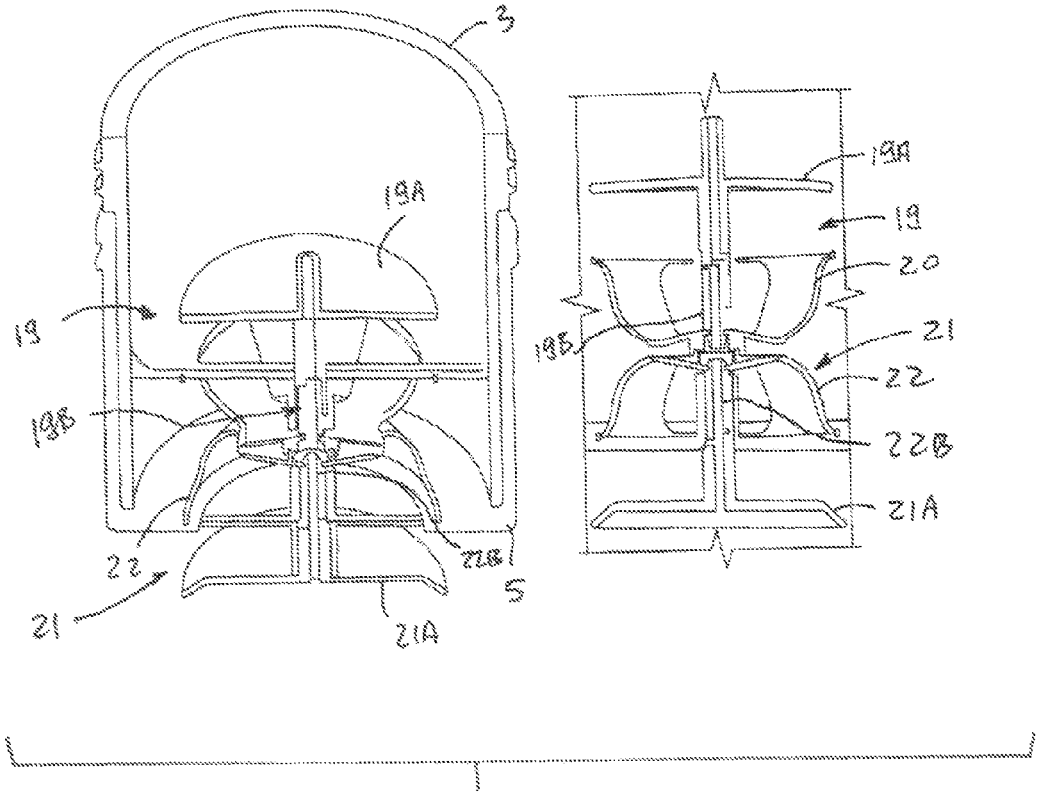

FIGS. 4*a* to 4*c* are cross-sectional views of a spout/nozzle of a preferred embodiment of a vessel according to the invention; and FIGS. 5*a* and 5*b* are cross-sectional views of a spout/nozzle of a preferred embodiment of a vessel according to the invention.

Figure 1:
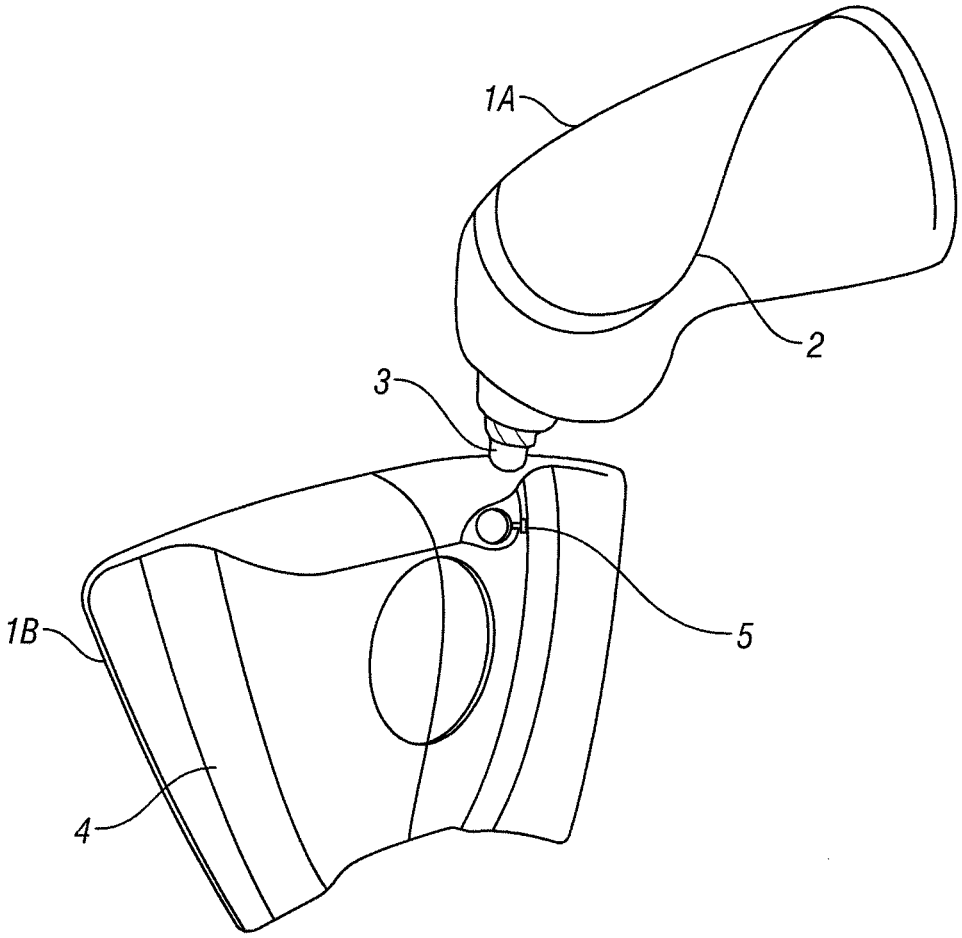
FIG. 1 is an perspective view of an separated reservoir and vessel according to the present invention.

In FIG. 1 it can be seen that the reservoir 1*a* comprises a housing 2 having a nozzle 3. Similarly it can be seen that the vessel 1*b* comprises a body 4 having a spout 5.

Figure 2:
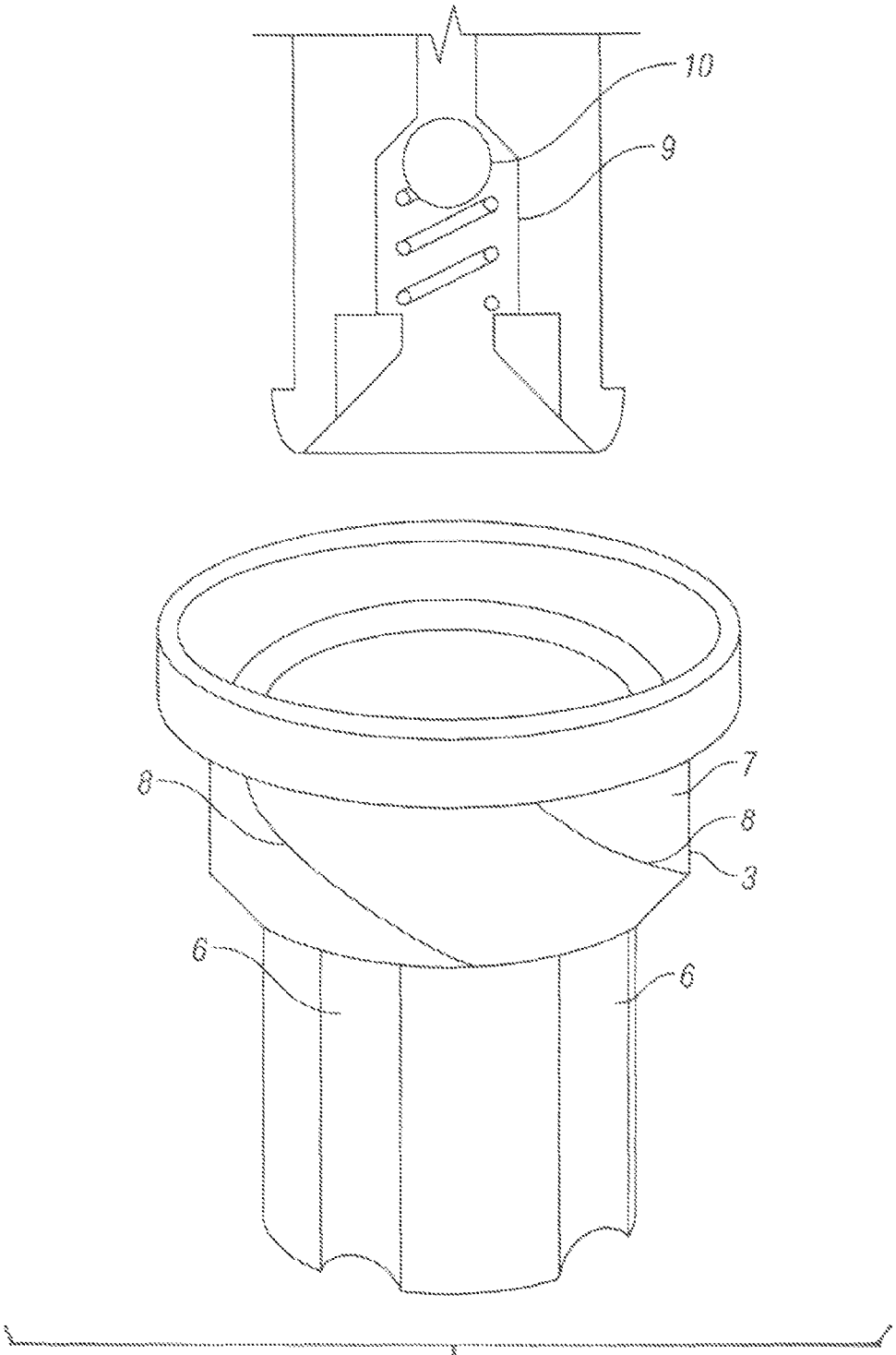
FIG. 2 is an exploded view of a nozzle of a preferred embodiment of a reservoir according to the invention.

In FIG. 2 more detail of a preferred embodiment of the nozzle 3 can be seen. The nozzle 3 has a plurality of axial incisions 6 (grooves) leading away from its terminus. Adjacent the incisions 6 there is a collar 7 which has a plurality of helical shaped lugs 8.

The nozzle 3 has a central bore 9. Disposed within the central bore 9 there is a biased ball valve 10, biased against a narrow section of the bore 9. This ball valve 10 prevents unwanted discharge of the contents of the reservoir 1*a* unless pressure is applied against the valve 10.

Figure 3:
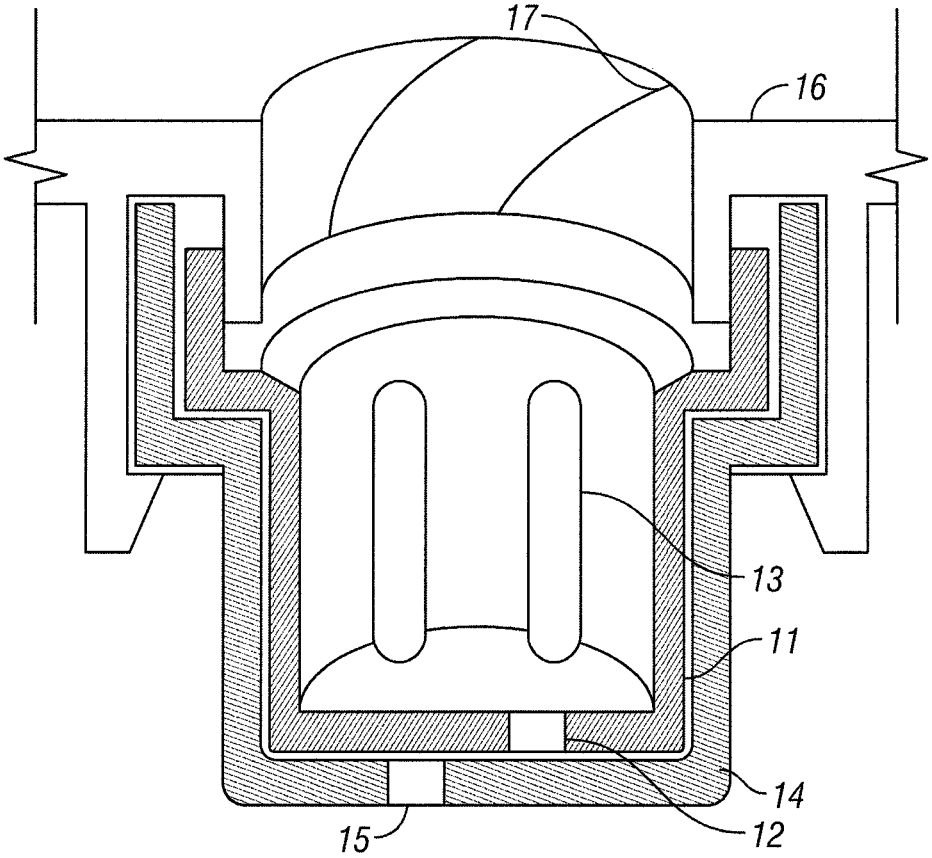
FIG. 3 is a cross-sectional view of a spout of a preferred embodiment of a vessel according to the invention.

In FIG. 3 more detail of a preferred embodiment of the spout 5 can be seen. The spout 5 comprises a cup 11 which is fixedly mounted to the vessel 1*b*. The cup 11 has a cup aperture 12. The cup 11 has a plurality of raised vanes 13 disposed around its edge.

The spout 5 has a closure 14. The closure 14 may be rotated relative to the spout 5. The closure 14 has a closure aperture 15. To allow fluid communication into the vessel 1*b* the closure aperture 15 and the cup aperture 12 has to be in at least partial alignment. The closure 14 has an associated collar 16 which is fixed to the closure 14 and similarly may be rotated relative to the vessel 1*b*. The inside of the collar 16 has a number of angled grooves 17.

In use the nozzle 3 is brought into alignment with the spout 5. The nozzle 3 is inserted into the spout 5. This insertion causes engagement of the lugs 8 with the angled grooves 17 and engagement of the incisions 6 with the raised vanes 13. Engagement of the lugs 8 with the angled grooves 17 and further insertion of the nozzle 3 into the spout 5 causes the closure 14 to be rotated relative to the vessel 1*b*, bringing the closure aperture 15 into alignment with the cup aperture 12. Detergent may then be dispensed from the reservoir 1*a* into the vessel 1*b*, working against the spring valve 10.

In FIGS. 4*a* to 4*c* more detail of a preferred embodiment of the nozzle 3 and spout 5 can be seen.

The spout 5 comprises a cup 11 which is fixedly mounted to the vessel 1*b*. The cup 11 has a cup aperture 12.

The spout 5 has a closure 14. The closure 14 may be rotated relative to the spout 5. The inside of the closure 14 has a has a number of angled grooves 17.

The closure 14 has a closure aperture 15. To allow fluid communication into the vessel 1*b* the closure aperture 15 and the cup aperture 12 has to be in at least partial alignment.

In use the nozzle 3 is brought into alignment with the spout 5. The nozzle 3 is inserted into the spout 5. This insertion causes engagement of the lugs 8 with the angled grooves 17.

Engagement of the lugs 8 with the angled grooves 17 and further insertion of the nozzle 3 into the spout 5 causes the closure 14 to be rotated relative to the vessel 1*b*, bringing the closure aperture 15 into alignment with the cup aperture 12.

Before the detergent can flow a twisting motion has to be applied to the nozzle 3. This twisting motion causes a biased nozzle closure 14*a* to be rotated relative to the nozzle and thus opening a nozzle discharge outlet 18.

Detergent may then be dispensed.

In FIGS. 5*a* and 5*b* more detail of a preferred embodiment of the nozzle 3 and spout 5 can be seen.

The nozzle 3 comprises a closure valve 19 comprising a flat plate 19*a* and a stem 19*b*. The valve 19 is biased into a closed position by a deformable spring 20 in the form of a dome.

The spout 5 comprises a closure valve 21 comprising a flat plate 21*a* and a stem 21*b*. The valve 21 is biased into a closed position by a deformable spring 22 in the form of a dome.

In use the nozzle 3 is brought into alignment with the spout 5. The nozzle 3 is inserted into the spout 5. This insertion causes abutment/engagement of the valve stems 19*b* and 21*b*. Further insertion of the nozzle 3 into the spout 5 causes movement of the valves 19 and 21 against their springs 20 and 22 respectively.

Detergent may then be dispensed.

It will be appreciated that the description of the diagrams shall not be taken to limit the scope of the invention in any way.

The invention claimed is:

1. A filling system for a detergent vessel comprising:

a reservoir having a dispensing nozzle comprising lugs; and, a detergent vessel having a filling spout, said filling spout having a cup having a cup aperture, and a moveable closure having a closure aperture, said moveable closure having angled grooves adapted to receive said lugs, which angled grooves have a portion which extends from a top open end of the cup in a direction diagonally and downwardly away from said top open end, and then continues to extend to a substantially horizontal portion which is generally parallel to the said top open end of the cup, which moveable closure is within the cup and is rotatable with respect to the cup between an inactivated position (closed position) wherein the cup aperture and the closure aperture are not in alignment, to an activated position (open position) wherein the cup aperture and the closure aperture are at least in partial alignment, and thereafter to the inactivated position (closed position), and, wherein the cup aperture and the closure aperture are in at least partial alignment (open position) when the dispensing nozzle is fully inserted into the moveble closure and the lugs are engaged within the angled grooves, said dispensing nozzle further having engagement means which when inserted into the filling spout engages a portion of the filling spout providing an effective seal therebetween.

2. A filling system according to claim 1, wherein the engagement means is mechanical or magnetic.

3. A filling system according to claim 1, wherein the system comprises a plastics material.

4. A filling system according to claim 1, wherein the reservoir contains a liquid composition.

5. A filling system for a detergent vessel according to claim 1 which further comprises:

a quantity of a detergent composition present within the reservoir and wherein the detergent composition may not be dispensed from the detergent vessel when the moveable closure is in an inactivated position (closed position), but when the moveable closure is in and an activated position (open position) the detergent composition may be dispensed from the reservoir through the dispensing nozzle and through the filling spout to the detergent vessel.

6. A filling system according to claim 5, wherein the filling system further comprises engagement means which is mechanical or magnetic.

7. A filling system according to claim 5, wherein the closure aperture and the cup aperture are in at least partial alignment when the dispensing nozzle is engaged within the filling spout.

8. A detergent dispensing reservoir having a dispensing nozzle, the dispensing nozzle having lugs adapted for engagement with a filling spout of a detergent vessel which filling spout has a cup having a cup aperture, and a moveable closure having a closure aperture within the cup, the moveable closure having corresponding angled grooves for receiving and engaging said lugs, said grooves have a portion which extends from a top en end of the cup in a direction diagonally and downwardly away from said top open end, and then continues to extend to a substantially horizontal portion which is generally parallel to the said top open end of the cup, wherein when the dispensing nozzle is fully inserted within the filling spout the lugs are engaged within the angled grooves and the cup aperture and the closure aperture are at least in partial alignment, and wherein the closure aperture and the cup aperture are not in alignment when the dispensing nozzle is not engaged within the filling spout.

9. A detergent vessel having a filling spout, the filling spout having a cup with a cup aperture, which cup is fixedly mounted to the detergent vessel, further having a moveable closure having a closure aperture within said cup, the moveable closure being moveable with respect to the cup, the moveable closure further comprising angled grooves adapted to receive lugs of a dispensing nozzle, which angled grooves have a portion which extends from a top open end of the cup in a direction diagonally and downwardly away from said top open end, and then continues to extend to a substantially horizontal portion which is generally parallel to the said top open end of the cup, wherein the cup aperture and the closure aperture are in at least partial alignment when said dispensing nozzle is engaged within the filling spout, and where the cup aperture and the closure aperture are not in alignment when the said dispensing nozzle is disengaged from the filling spout.

* * * * *